US006193019B1

(12) United States Patent
Sirigu et al.

(10) Patent No.: US 6,193,019 B1
(45) **Date of Patent: *Feb. 27, 2001**

(54) DEVICE FOR LOCALIZATION OF A DOOR BREAKDOWN

(75) Inventors: Gerard Sirigu; Pascal Rebillard, both of Gien (FR)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/282,960

(22) Filed: Apr. 1, 1999

(51) Int. Cl.[7] ..... B66B 3/00
(52) U.S. Cl. ..... 187/391
(58) Field of Search ..... 187/391, 393, 187/280, 316; 49/26, 120

(56) References Cited

U.S. PATENT DOCUMENTS 3,882,969 * 5/1975 Podcameni et al. ..... 187/29 R
4,750,591 * 6/1988 Coste et al. ..... 187/130
5,057,699 10/1991 Spence ..... 307/98
5,107,964 * 4/1992 Coste et al. ..... 187/104
5,780,787 * 7/1998 Kamani et al. ..... 187/316
5,787,020 * 7/1998 Molliere et al. ..... 364/550
6,070,700 * 6/2000 Nagel ..... 187/335

FOREIGN PATENT DOCUMENTS 0 149 727 A1 7/1985 (EP) ..... B66B/5/00
2 558 278 A1 7/1985 (FR) ..... G05B/23/00

* cited by examiner

*Primary Examiner*—Jonathan Salata

(57) ABSTRACT

The invention concerns a device for localizing a closing fault in landing doors equipped with locks that are electrically connected series.

The localizing device includes a number of electric impedances ($R_0$, $R_1$, $R_2$ . . . $R_n$) respectively mounted in parallel with said locks ($12_0$, $12_1$, $12_2$ . . . $12_n$), measuring devices (42, 44) for measuring the total impedance of the safety chain, microprocessor (46) which allow to compare said measured impedance with a cross reference table of floor impedances that provides all the impedance values of the safety chain obtained by opening one or the other of the landing doors, and display (48) which show the floor or floors on which the breakdown occurred.

9 Claims, 1 Drawing Sheet

DEVICE FOR LOCALIZATION OF A DOOR BREAKDOWN

TECHNICAL FIELD

This invention concerns the area of detecting closing faults in elevator landing doors, and more particularly faults taking place in the landing door locks. It concerns more precisely a device which permits to localize without hesitation the defective lock in an elevator having suffered a breakdown, without the need to examine all the locks of the installation.

BACKGROUND OF THE INVENTION

It is known to ensure the safety of an elevator's operation by means of a safety chain. The latter includes an electric line fed by a power source, where all the landing door locks are installed in series the line. When all the locks are secured and in good operating condition, the safety chain is complete and a current passes through it. The chain governs a control device which powers the driving motor of the elevator cabin.

By contrast the safety chain is incomplete if even one of the locks is defective: the motor is not powered and the cabin remains in the stopped position. It is then necessary to intervene to repair the defect. If the latter is apparent it is easy to discover and repair it, but in the contrary case, for example when all the landing doors are properly closed and the cabin does not operate in spite of this, it is necessary to check all the landing doors individually, as well as all the locks. At best this work can be performed fairly easily and without much effort when the installation only has one or two floors, but in the case of a building with a large number of floors, the search of the defect is tedious, lengthy and costly.

DISCLOSURE OF THE INVENTION

The object of the present invention is to remedy this drawback by proposing a device which enables detecting a fault in the landing door locks of an elevator installation and automatically signaling the location of this fault in order to save the repair technician searching time.

According to the present invention, a device is provided for locating the defective closing of landing doors that are equipped with locks in an elevator installation of several floors, where said installation is equipped with an electrical safety chain connecting said locks in series; the device is characterized in that it comprises:

a number of electric impedances respectively mounted in parallel on said locks, where said impedances have specific values that differ from each other;

means for measuring the total impedance of the safety chain;

means for comparing said measured impedance with a cross reference table of floor impedance values, including all the previously determined values wherein the floor on which the breakdown occurred is the one where the measured impedance matches the impedance of the table;

and display means to indicate the floor or floors where the breakdown occurred.

Advantageously said impedances are made of pure resistances. The specific impedances are chosen as the powers of 2 and are provided by the formula:

$$R_i = R_0 2^i,$$

where $R_0$ is a predetermined constant resistance and i is a whole number between 0 and n that corresponds to the number of the floor.

BRIEF DESCRIPTION OF THE DRAWINGS

The preferred configuration mode of the invention will now be described in detail by means of the attached drawings wherein.

BEST MODE FOR CARRYING OUT THE INVENTION

Figure 1:
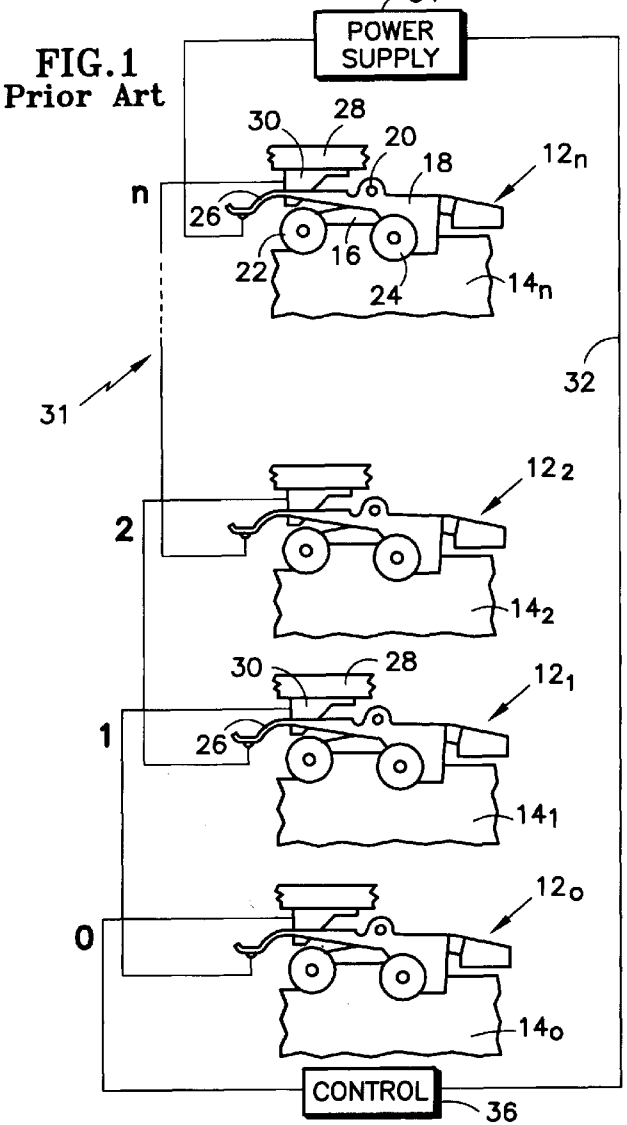
FIG.1 Prior Art
FIG. 1 is a schematic illustration of a prior art safety chain in an elevator installation.

With reference to FIG. 1, the elevator installation services a ground floor and n floors respectively numbered 0, 1, 2, . . . n. The landings have landing doors $\mathbf{14}_0$, $\mathbf{14}_1$, $\mathbf{14}_2$, . . . $\mathbf{14}_n$ that can be secured in the closed position by locks $\mathbf{12}_0$, $\mathbf{12}_1$, $\mathbf{12}_2$, . . . $\mathbf{12}_n$ which are typically mounted on the moving panels of the landing doors. A typical installation includes a lock having a first piece 16 attached to the upper part of the panel 14, and a second piece 18 with is mounted so that it pivots with respect to the first part around a horizontal axis 20. Said pieces 16 and 18 are equipped with rollers 22, 24 which will not be described further because they are not the object of the invention.

The pivoting piece 18 has a sliding bolt 26 containing an opening that is not visible in FIG. 1. The fixed jamb 28 of the landing door has a latch 30 which can penetrate into the opening of the sliding bolt when the panel 14 is in the closed position. The sliding bolt 26 is equipped with an electrical contact (not shown), which is switched during operation when the latch 30 is properly engaged in the opening of the sliding bolt.

The elevator installation is equipped in the well known manner with a safety chain 31 which only allows the elevator to operate only when all the landing doors are closed and all the locks are secured.

The safety chain includes an electric line 32 fed by a power source 34 in which the locks 12 found on all the floors are mounted in series, and a control device 36 that is used to govern the operation of the elevator installation's motor.

As shown in FIG. 1, each lock has a latch 30 which is electrically connected to the sliding bolt 26 of the lock on the next lower floor, and its sliding bolt 26 is electrically connected to the latch 30 of the lock on the next higher floor.

From the electrical point of view, each lock can be characterized as an electric switch that is open when the lock is open and is closed when the lock is closed.

The safety chain is complete when all the landing doors and their locks are closed. A current flows through the chain and feeds the control device 36. The elevator is therefore able to operate. By contrast, if one of the doors is improperly closed or one of the locks is improperly secured, the safety chain is open and the elevator cannot function. It is then necessary to check all the landing doors and all the locks to discover the faulty one.

Figure 2:
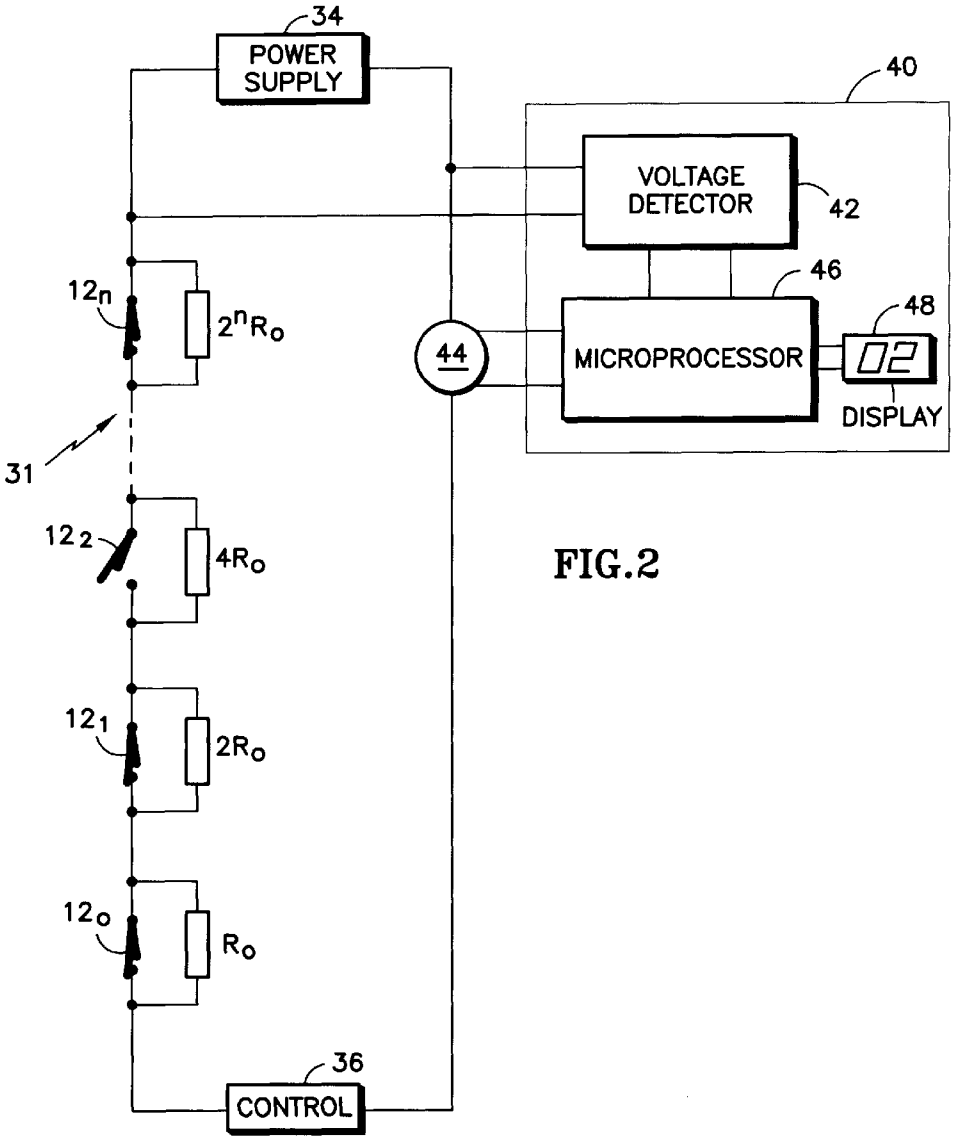
FIG. 2 shows a schematic electric diagram of the safety chain in FIG. 1, where said safety chain is equipped with a device for localizing the faults according to the invention.

FIG. 2 shows a localization device in accordance with the invention which does not have this drawback since it allows detecting and automatically signaling of the place where the fault is found. In this figure the locks are illustrated in simplified form by means of electrical switches $\mathbf{12}_0$ to $12_n$. In accordance with the invention the locks have impedances $R_0$ to $R_n$ respectively mounted in parallel, with values that differ from each other. Said impedances can be formed of pure resistances.

The values of these resistances are preferably provided by the formula:

$$R_i=R_0 2^i$$

where $R_0$ is a continuous resistance selected to be able to withstand the fill power from the source, and i is a whole number between 0 and n and corresponds to the floor number. Thus the resistance values at the different floors from bottom to top are: $R_0$, $2R_0$, $4R_0$, . . . $2^nR_0$.

The locating device also comprises a locating panel 40 which includes a voltage measuring device 42 to measure the supply voltage V provided by the power source 34, an intensity measuring device 44 to measure the intensity I flowing through the safety chain, a microprocessor 46 which computes the impedance of the safety chain starting with the measured voltage and intensity values, and, in the embodiment illustrated in FIG. 2, a display device 48 controlled by the microprocessor on which the number of the floor where the fault is located can be shown.

The microprocessor includes a memory unit in which a cross reference table of floor-impedances is stored. This table may be determined as follows: the total impedance p of the safety chain is measured when the landing doors of all floors are closed and the locks are secured. As shown in FIG. 2, the resistances $R_0$ to $R_n$ are then short-circuited. This situation corresponds to the case where there is no fault in the installation.

Then, while the landing doors of all floors are kept closed, only that of the ground floor is opened and the impedance of the safety chain is again measured. Of course $\rho+R_0$ is found. This situation corresponds to the case where a fault exists in the ground floor lock.

In the same manner the ground floor landing door is closed and that of the first floor is opened. The measured impedance of the safety chain will be $\rho+2R_0$. This is repeated for all the other landing doors on all the floors. As will be appreciated by those skilled in the art, table values may also be determined by calculating the expected impedances, or by total measurement at each switch.

Thus the cross reference table of floor-impedances stored in the memory unit is as follows:

| Floor | | 0 | 1 | 2 | 3 | n |
|---|---|---|---|---|---|---|
| Impedance | p | $p + R_0$ | $p + 2R_0$ | $p + 4R_0$ | $p + 8R_0$ | $p + 2^nR_0$ |

This table therefore establishes a relationship between the floor numbers and the impedances.

In the event a breakdown takes place, the microprocessor identifies the number of the floor where the fault occurred in the following manner: starting with the voltage and intensity values V and I measured by the measuring devices 42 and 44, the microprocessor 46 computes the safety chain's impedance value V/I and compares it with the values in the preceding table. Since this table represents all the situations, the impedance computed by the microprocessor must therefore correspond to one or the other value of the table. The thus identified floor number is then shown on the display device 48.

In the example of FIG. 2, it is assumed that the lock of the second floor is defective. The switch 122 is shown open and all the other switches are closed. The display device 48 shows the number 02 of the floor where the fault occurred.

In accordance with a variation in the configuration, it can happen that no resistance $R_0$ is used for the lock on the ground floor. In that case the cross reference table is changed by replacing $\rho+R_0$ in column 0 by the value 0, since the safety chain is open if a fault takes place in the lock on the ground floor. The parallel impedances of the locks are then provided by the formula $R_i=R_1$, $2^i$, where i is a whole number between 1 and n which corresponds to the floor number where the ground floor is not included.

The preceding table was established by assuming that a fault takes place in a single lock. However a case can be conceived where faults occur simultaneously in two or more locks. In that case the table must be completed with the respective values of safety chain impedances measured by opening two or more landing doors at the same time. The display device then simultaneously shows the floors where the faults took place.

It will further be appreciated that the display device 48 as shown in the embodiment of FIG. 2 may be replaced or augmented by other means for communicating the location of the detected fault, such as a remote monitoring panel or system, mechanic's electronic tool, annunciator, etc.

What is claimed is:

1. A device for localizing a closing fault in a landing door equipped with locks in an elevator installation of several floors, where said installation is equipped with an electrical safety chain (31) which connects said locks in series, said device being characterized in that it comprises:

a number of electrical impedances mounted respectively in parallel with said locks, where said impedances have specific values which differ from each other, means for measuring the total impedance of the safety chain, means which allow to compare said measured impedance with a floor-impedance cross reference table containing all the impedance values of the safety chain, wherein the floor on which the closing fault occurred is the one where the measured impedance matches an impedance of the table, and and means for communicating the floor or floors on which the breakdown occurred.

2. A localizing device as claimed in claim 1, characterized in that said impedances are formed by pure resistances.

3. A localizing device as claimed in claim 1, characterized in that said impedances are chosen as the powers of 2 and are provided by the formula:

$$R_i=R_0 2^i,$$

where $R_0$ is a constant predetermined resistance and i is a whole number between 0 and n which corresponds to the floor number.

4. A localizing device as claimed in claim 1, characterized in that said impedances are provided by the formula $R_i=R_i 2^i$, where i is a whole number between 1 and n which corresponds to the floor numbers, not including the ground floor.

5. A localizing device as claimed in claim 1, characterized in that said means of measuring the impedance include a measuring device for the supply voltage of the safety chain, and a measuring device for the intensity of the current in the safety chain.

6. A localizing device as claimed in one of claim 1 characterized in that said means of comparison are provided by a microprocessor which constantly computes the impedance of the safety chain starting with the measured voltage and intensity values.

7. A localizing device as claimed in one of claim 5, where said microprocessor includes a memory unit in which said cross reference table of floor-impedances is stored.

8. A localizing device as claimed in claim 1, characterized in that the cross reference table is obtained by measuring the impedance of the safety chain after opening a single landing door at a time, and doing this for each landing door.

9. A localizing device as claimed in claim 1, characterized in that the cross reference table is obtained by measuring the impedance of the safety chain after opening two or more landing doors at a time, and doing this for each possible combination.

* * * * *